United States Patent [19]

Blair

[11] 3,995,525

[45] Dec. 7, 1976

[54] METHOD FOR MANUFACTURING DETONATING FUSE-CORD

[75] Inventor: Joseph Potter Blair, Dundonald, Scotland

[73] Assignee: Imperial Chemical Industries Limited, London, England

[22] Filed: May 12, 1975

[21] Appl. No.: 576,571

[30] Foreign Application Priority Data

May 20, 1974 United Kingdom ..... 22424/74

[52] U.S. Cl. ..... 86/22; 86/1 R; 102/27 R

[51] Int. Cl.[2] ..... F42B 3/10

[58] Field of Search ..... 86/1 R, 20 R, 22; 102/27 R; 149/7, 11, 93

[56] References Cited

UNITED STATES PATENTS

| | | | |
|---|---|---|---|
| 1,705,360 | 3/1929 | Fritzche | 86/1 R |
| 2,498,050 | 2/1950 | Selvidge | 102/27 R |
| 2,923,239 | 2/1960 | Andrew et al. | 102/27 R |
| 3,320,847 | 5/1967 | Kelly et al. | 86/20 R |
| 3,683,742 | 8/1972 | Rohde et al. | 86/1 R |
| 3,773,572 | 11/1973 | Thomas | 102/27 R X |
| 3,908,509 | 9/1975 | Kelly et al. | 86/20 R X |

FOREIGN PATENTS OR APPLICATIONS

| | | | |
|---|---|---|---|
| 1,120,200 | 7/1968 | United Kingdom | 102/27 |
| 1,378,669 | 12/1974 | United Kingdom | 102/27 |

*Primary Examiner*—Harold Tudor
*Attorney, Agent, or Firm*—Cushman, Darby & Cushman

[57] ABSTRACT

A detonating cord and the manufacture thereof wherein a center yarn disposed in a core of compacted particulate explosive material is treated with silicone oil which migrates through the explosive material and renders the material water resistant.

10 Claims, 1 Drawing Figure

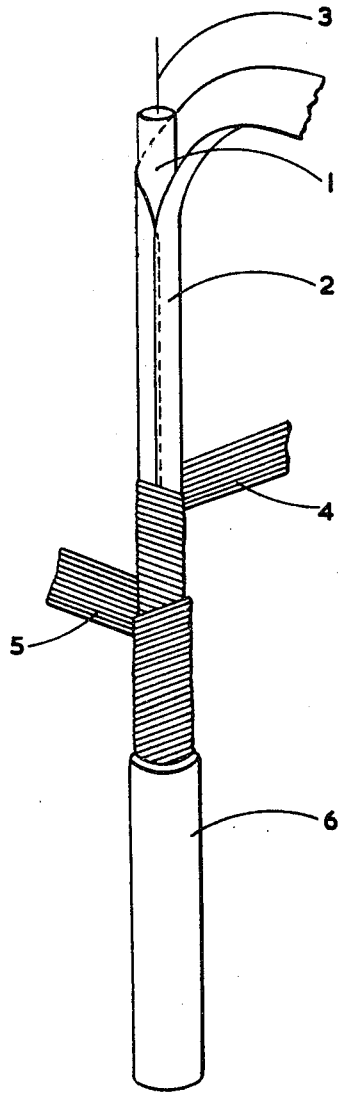
3
1
2
4
5
6

METHOD FOR MANUFACTURING DETONATING FUSE-CORD

This invention relates to the manufacture of detonating fusecord, hereinafter referred to as detonating cord, and particularly relates to the manufacture of detonating cord wherein the explosive core is treated with silicone to improve its water resistance. The invention also includes the modified detonating cord.

Detonating cord is widely used for detonation transmission lines for blasting and for generating seismic waves in land and marine seismographic prospecting. The construction and manufacture of one form of detonating cord is described in United Kingdom patent specification No. 1,120,200. Generally, the explosive core consists of compacted high explosive particles encased in a thin paper or plastics tube reinforced with wrapping materials usually comprising one or more spun layers of textile yarns surrounded by a waterproof sheath of theremoplastics material. In the manufacture of cords of this construction, a longitudinal tape is continually convoluted to form a thin tube by passing it through a die, particulate explosive material is continuously fed through the die into the tube thus formed and consolidated by passing the tube through compacting dies, textile yarns on bobbins rotating around the tube are continuously helically wound around the tube and the thermoplastics sheath is extruded around the yarns. In order to assist the flow of the particulate explosive material into the tube, one or more centre yarns are continuously drawn through the die as the detonating cord is formed and remains in the finished cord.

The explosive core of commercial detonating cord is readily desensitised by water and the cord cannot usually be initiated to detonation at an open end of the cord which has been immersed in water. One method of successfully counteracting water desenitisation is to coat the particulate explosive material of the core with silicone. Thus, the treatment of pentaerythritol tetranitrate (PETN) is described and claimed in our United Kingdom patent application Ser. No. 1,355,234, the preferred method being to co-precipitate the PETN and silicone from a solution in acetone.

We have now found that the resistance to water desensitisation can be advantageously obtained by applying liquid silicone, hereinafter termed silicone oil, to the centre yarn so that the silicone migrates from the yarn to the surrounding explosive in the core of the detonating cord. Separate treatment of the explosive material with silicone oil is thereby avoided.

Thus, in accordance with this invention, in the manufacture of detonating cord wherein one or more centre yarns are disposed in a core of compacted particulate explosive material and surrounded with reinforcing wrapping materials, the said centre yarn is treated with silicone oil part of which subsequently migrates through the explosive material.

The centre yarn may suitably be of a natural or synthetic plastics fibre such as, for example, cotton or polypropylene and may, for example, be in the form of a thread of circular cross-section or a flat or twisted tape. The yarn is conveniently treated with silicone oil by immersing a bobbin of yarn in the oil and allowing the excess oil to drain off.

The silicone conveniently comprises a polysiloxane containing unit having the structure $R_xSiO_{(4-x)/2}$ wherein R is hydrogen or a monovalent hydrocarbon group, not more than one hydrogen atom being attached to any Si atom, and $x$ is 1 or 2. Preferably the silicone comprises a linear polysiloxane having the formula $(CH_3)_3Si\ [OSiR_2]_n\ OSi(CH_3)_3$ wherein R is hydrogen or alkyl and $n$ is an integer, or a cyclic polysiloxane having the formula $[SiR_2O]_n$ wherein R is hydrogen or alkyl and $n$ is an integer of 3 to 8.

Preferred linear polysiloxanes include trimethyl siloxy end-blocked polymethyl-hydrogen siloxane and trimethyl siloxy end-blocked polydimethyl siloxane and it is preferred that these polysiloxanes should contain on average 40 to 100 polysiloxane ($-SiR_2O$) units in their molecules.

Preferred cyclic polysiloxanes include, for example, cyclotetradimethyl siloxane and cyclo-tetramethylhydrogen siloxane.

The compacted particulate explosive is conveniently PETN. The explosive core is conveniently encased in a paper or plastics tubular envelope, reinforced with textile reinforcing yarn spun around the envelope and a waterproof plastics sheath extruded around the reinforcing yarn.

The invention also includes a detonating cord comprising a core of particulate explosive material having a centre yarn which has been treated with silicone oil.

The construction and manufacture of detonating cord in accordance with the invention is hereinafter described, by way of example only, with reference to the accompanying drawing showing diagrammatically a length of fusecord with one end dissected to illustrate the manufacturing sequence.

In the manufacture of the detonating cord a central core 1 of particulate explosive material is fed from a hopper exit into a thin tube 2 formed by convolution of a tape. A yarn 3 impregnated or coated with silicone oil is trained through the hopper exit and along the axis of the tube 2 to remain within the core 1. The tube 2 is surrounded by a spun layer of textile yarn 4 and a counterspun layer of textile yarn 5 and the layer 5 is coated with an extruded layer of thermoplastics material. The cord may be readily manufactured in the plant normally used for the manufacture of detonating cord. The silicone oil migrates from the central yarn 3 through the explosive in the core 1 soon after the cord is manufactured.

The following specific Examples further illustrate the practice of the invention.

EXAMPLE 1

In this Example the centre yarn 3 was a single 1000 denier polypropylene tape 3 mm wide and 0.08 mm thick having a twist of 80 turns per meter. It had been immersed in a silicone oil consisting of trimethyl siloxy end-blocked polymethylhydrogen siloxane having about 50 methylhydrogen siloxane units per molecule, commercially available as Silicone Oil DP42 from Imperial Chemical Industries Limited.

The explosive core 1 was crystalline PETN and the tube 2 was 0.013 mm thick polypropylene film. The layer 4 consisted of eight yarns of the same polypropylene tape as centre yarn 3 (but without twist) wound at 26 turns per meter and the layer 5 consisted of 10 yarns of the same polypropylene tape as in layer 4 wound at 39 turns per meter. The sheath 6 was a polyvinyl chloride composition commercially available as 'Welvic' (Registered Trade Mark).

In a wet initiation test the open ends of sample lengths were immersed in water to a depth of 25 centimeters and tested at intervals for initiation by the side blow from a No. 6 ASA detonator (0.24 g PETN base charge) strapped to the end which had been immersed. The samples fired after 72 hours immersion whereas, in the same test with samples of a detonating cord identical to this Example but without the silicone oil, the PETN core became waterlogged and all failed after 5 hours immersion.

EXAMPLE 2

The detonating cord of this Example was the same as Example 1 except that the centre yarn 3 was a cotton yarn having a weight of 0.05 g/meter and the silicone oil was a trimethyl siloxy end-blocked polydimethyl siloxane having about 90 dimethyl siloxane units per molecule, commercially available as silicone oil F111/100 Imperial Chemical Industries Limited.

In the wet initiation test this Example gave the same results as Example 1.

EXAMPLE 3

The detonating cord of this Example was the same as Example 1 except that the centre yarn was 760 denier polypropylene filament and the silicone oil was cyclo-tetramethylhydrogen siloxane commercially available as silicone oil EP5823 from Imperial Chemical Industries Limited.

In the wet initiaion test this Example gave the same results as Example 1.

EXAMPLE 4

The detonating cord of this Example was the same as Example 1 except that the silicone oil was cyclo-tetradimethyl siloxane.

In the wet initiation test this Example gave the same results as Example 1.

What we claim is:

1. In a method of manufacturing detonating fuse cord by steps which include forming a tube by continuously convoluting a longitudinal tape and passing it through a die, flowing particulate explosive material through the die into the tube while assisting the flow of the particulate explosive material into the tube by drawing at least one center yarn through the die as the cord is formed, and leaving the yarn in the completed cord, the improvement wherein the center yarn which is passed through the die is a yarn having silicone oil applied thereto prior to passing the yarn through the die whereby the silicone oil migrates from the yarn to the surrounding explosive material in the completed cord.

2. A method as claim in claim 1 wherein the centre yarn is made of plastics fibre.

3. A method as claimed in claim 1 wherein the centre yarn is made of cotton.

4. A method as in claim 2 wherein the yarn is made of polypropylene.

5. A method as claimed in claim 1 wherein the centre yarn is in the form of a thread of circular cross-section.

6. A method as in claim 1 wherein the yarn is a tape.

7. A method as claimed in claim 1 wherein the silicone oil is applied to the centre yarn by immersing the yarn in the oil.

8. A method as claimed in claim 1 wherein the silicone oil comprises polysiloxane containing units having the construction $R_xSiO_{(4-x)/2}$ wherein R represents a member of the group consisting of hydrogen and monovalent hydrocarbon radicals, not more than one hydrogen atom being attached to any Si atom, and $x$ is 1 or 2.

9. A method as claimed in claim 8 wherein the silicone oil comprises linear polysiloxanes having the formula $(CH_3)_3Si\ [OSiR_2]_nOSi(CH_3)_3$ wherein R represents a member of the group consisting of hydrogen and alkyl radicals and $n$ is an integer, cyclic polysiloxanes having the formula $[SiR_2O]_n$ wherein R represents a member of the group consisting of hydrogen and alkyl radicals and $n$ is an integer of 3 to 8.

10. A method as claimed in claim 8 wherein the polysiloxane is selected from the group consisting of trimethyl siloxy end-blocked polymethyl-hydrogen siloxane, trimethyl siloxy end-blocked polydimethyl siloxane, cyclo-tetradimethyl siloxane and cyclo-tetramethylhydrogen siloxane.

* * * * *